US010715900B2

(12) United States Patent
Duckwall

(10) Patent No.: US 10,715,900 B2
(45) Date of Patent: Jul. 14, 2020

(54) HEADPHONE EARCUP

(71) Applicant: ZaanU Tech LLC, Washington, DC (US)

(72) Inventor: Nicholas Duckwall, Washington, DC (US)

(73) Assignee: ZaanU Tech LLC, Washington, DC (US)

( * ) Notice: Subject to any disclaimer, the term of this patent is extended or adjusted under 35 U.S.C. 154(b) by 155 days.

(21) Appl. No.: 16/164,169

(22) Filed: Oct. 18, 2018

(65) Prior Publication Data

US 2019/0116411 A1 Apr. 18, 2019

Related U.S. Application Data

(60) Provisional application No. 62/573,732, filed on Oct. 18, 2017.

(51) Int. Cl.

| | |
|---|---|
| ***H04R 25/00*** | (2006.01) |
| ***H04R 1/10*** | (2006.01) |
| ***H04R 1/28*** | (2006.01) |

(52) U.S. Cl.

CPC ..... *H04R 1/1008* (2013.01); *H04R 1/1016* (2013.01); *H04R 1/1058* (2013.01); *H04R 1/2857* (2013.01)

(58) Field of Classification Search

CPC .. H04R 1/1008; H04R 1/1016; H04R 1/1058; H04R 1/2857

USPC ..... 381/309, 371, 380, 310, 382; 2/423

See application file for complete search history.

(56) References Cited

U.S. PATENT DOCUMENTS

| | | | | |
|---|---|---|---|---|
| 6,229,901 | B1 * | 5/2001 | Mickelson | A61F 11/008 381/371 |
| 8,000,486 | B2 * | 8/2011 | Hildebrandt | H04R 1/1075 381/310 |
| 8,175,316 | B2 * | 5/2012 | Yamagishi | H04R 1/2819 381/382 |
| 2006/0015989 | A1 * | 1/2006 | Faussett | H04R 5/0335 2/423 |
| 2018/0192227 | A1 * | 7/2018 | Woelfl | H04R 5/033 |
| 2020/0137476 | A1 * | 4/2020 | Shinmen | H04R 23/02 |

* cited by examiner

*Primary Examiner* — Md S Elahee
(74) *Attorney, Agent, or Firm* — Maskell Law PLLC; Benjamin E. Maskell

(57) ABSTRACT

Disclosed is a headphone earcup having a frame with an inside surface to be positioned adjacent a user's head, an outside surface opposite the inside surface, and a perimeter surface. A central hole in the frame extends from the inside surface to the outside surface. A removable cover on the outside surface of the frame covers the central hole in the frame. A first wave guide holds an earbud. The first wave guide has a perimeter surface and is sized in relative proportions to nest in the central hole of the frame. A second wave guide is positioned on the inside surface of the frame and is covered by a ported cover. A padded cover is positioned over the cover of the second wave guide for comfort.

20 Claims, 14 Drawing Sheets

HEADPHONE EARCUP

This application is a non-provisional of U.S. Application 62/573,732 filed Oct. 18, 2017 the entirety of which is hereby incorporated by reference.

BACKGROUND OF THE INVENTION

Field of the Invention

The embodiments of the invention relate headphones, and more particularly, to an earcup for over-the-ear style headphones. Although embodiments of the invention are suitable for a wide scope of applications, it is particularly suitable for integrating earbuds into over-the-ear style headphones.

Discussion of the Related Art

Mainstream headphone technology includes three primary types of headphones. First, minimalist earbud-style headphones rest in the ear and may engage structures of the ear to be retained therein. Second, on-ear style headphones generally include speaker housings that are pressed against the outer surfaces of the ears and can be held in place with a headband. Third, over-the-ear style headphones generally have large speaker housings that completely surround the ear and press against a user's head.

Earbuds can be very inexpensive and are commonly distributed as an included accessory with mobile telephones. Earbuds can also be very expensive such as wireless earbuds provided by premium device manufacturers. There exists demand, however, for the generally more expensive over-the-ear style headphones. Many users demand these over-the-ear style headphones for their generally superior sound reproduction as compared to earbuds. Users may also demand over-the-ear headphones for the social status and recognition that may come from having brand-name over-the-ear headphones such as those popularized by Dr. Dre with the Beats line of over-the-ear headphones. Still further demand exists for aesthetically customizable over-the-ear headphones so that a user can display individual expression.

Despite demand for over-the-ear headphones as opposed to earbuds, over-the-ear can be unattainable for many due to economic constraints of many members of the consuming public. Thus, there is a need for inexpensive over-the-ear style headphones.

SUMMARY OF THE INVENTION

Accordingly, embodiments of the invention are directed to a headphone earcup that substantially obviates one or more of the problems due to limitations and disadvantages of the related art.

An object of embodiments of the invention is to provide low cost over-the-ear headphones that integrate earbuds.

Another object of embodiments of the invention is to provide aesthetically customizable over-the-ear headphones.

Yet another object of embodiments of the invention is to provide passive sound conditioning earbuds.

Still another object of embodiments of the invention is to provide sound isolation for earbuds.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a headphone earcup includes a frame having an inside surface to be positioned adjacent a user's head, an outside surface opposite the inside surface, and a perimeter surface, a central hole in the frame extending from the inside surface to the outside surface, a removable cover on the outside surface of the frame, the removable cover covering the central hole in the frame, a first wave guide for holding an earbud, the first wave guide having a perimeter surface and sized in relative proportions to nest in the central hole of the frame, a second wave guide positioned on the inside surface of the frame, a cover for the second wave guide, and a padded cover over the cover of the second wave guide.

In another aspect, a headphone earcup includes a frame having an inside surface to be positioned adjacent a user's head, an outside surface opposite the inside surface, and a perimeter surface, a central hole in the frame extending from the inside surface to the outside surface, a slot extending radially from the central hole through the perimeter surface, a first wave guide for holding an earbud and having a perimeter surface, the first wave guide sized in relative proportions to nest in the central hole of the frame, a central hole in the first wave guide, the central hole of the first wave guide sized in relative proportions to receive the earbud, a slot of the first wave guide for receiving a stem of the earbud, the slot extending radially from the central hole of the first wave guide to the perimeter surface of the first wave guide, a second wave guide, a central hole of the second wave guide, a ring-shaped channel partially surrounding the central hole of the second wave guide, the ring-shaped channel having a first end and a second end, and a cover for the second wave guide.

In yet another aspect, a headphone earcup includes a frame having an inside surface to be positioned adjacent a user's head, an outside surface opposite the inside surface, and a perimeter surface, a central hole in the frame extending from the inside surface to the outside surface, a slot extending radially from the central hole through the perimeter surface, a first wave guide for holding an earbud and having a perimeter surface, the first wave guide sized in relative proportions to nest in the central hole of the frame, a central hole in the first wave guide, the central hole of the first wave guide sized in relative proportions to receive the earbud, a first port of the first wave guide, the first port extending radially from the central hole of the first wave guide to the perimeter surface of the first wave guide, a slot of the first wave guide for receiving a stem of the earbud, the slot extending radially from the central hole of the first wave guide to the perimeter surface of the first wave guide, a second wave guide, a central hole of the second wave guide, a ring-shaped channel partially surrounding the central hole of the second wave guide, the ring-shaped channel having a first end and a second end, a first port of the second wave guide, the first port opening from the central hole of the second wave guide to the ring-shaped channel near the first end of the ring-shaped channel, a cover for the second wave guide, a central hole of the cover for the second wave guide, and a port in the cover for the second wave guide, the port radially offset from the central hole of the cover, and positioned such that when the cover for the second wave guide is mated with the second wave guide, that the port in the cover for the second wave guide is disposed over the second end of the ring-shaped channel of the second wave guide.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
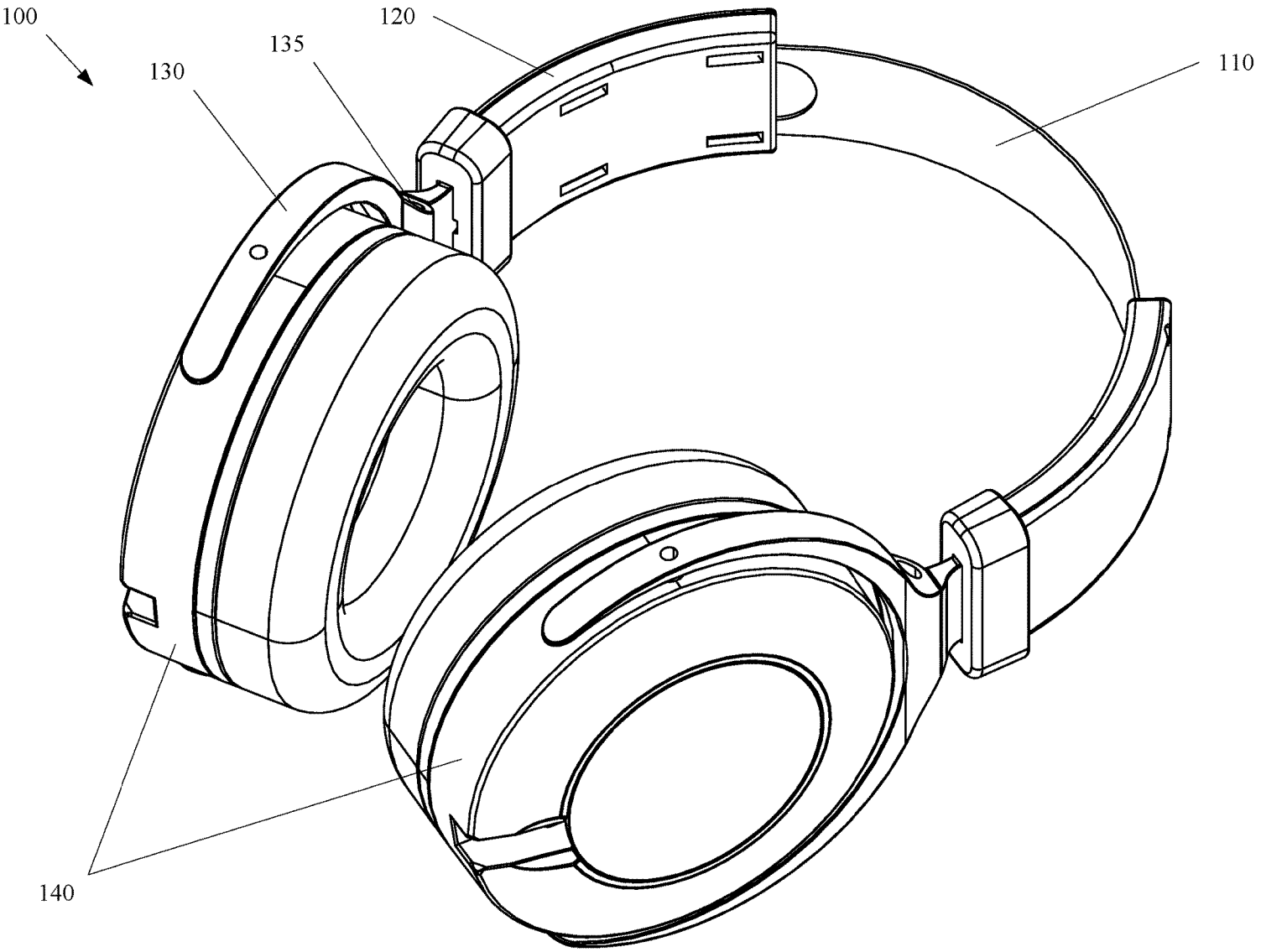
FIG. 1 is an isometric view of headphones incorporating earcups according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

The disclosure of the invention herein may refer to the relative location of features such as the "top" or "inside." In the absence of clarifying language, these relative terms are used in the contemplation that a user is wearing headphones (e.g. FIG. 1) on the head with the headband generally disposed over the top of the head and the earcups disposed generally over the ears. The term "top" of a feature or structure means generally the highest portion and, in the case of the disclosed earcups and the components thereof, the portion closest to the headband. The term "bottom" of a feature or structure means generally the lowest portion and, in the case of the disclosed earcups and the components thereof, the portion furthest from the headband. The term "outside" of a feature or structure means generally, with respect to headphones worn on a user's head, the outward facing portion and, in the case of the disclosed earcups and the components thereof, the portion furthest from a user's ear. The term "inside" of a feature or structure means generally, with respect to headphones worn on a user's head, the inward facing portion and, in the case of the disclosed earcups and the components thereof, the portion closest to a user's ear. The term "front" of a feature or structure means generally, with respect to headphones worn on a user's head, the portion facing in the same direction as a user's face. The term "back" of a feature or structure means generally, with respect to headphones worn on a user's head, the portion facing in the opposite direction as a user's face.

FIG. 1 is an isometric view of headphones incorporating earcups according to an exemplary embodiment of the invention. As shown in FIG. 1, over-the-ear headphones 100 can include a headband 110, a sliding size adjuster 120, bracket 130, hinge 135, and earcups 140.

The headband 110 can connect the left and right sides (not labeled) of the headphones 100 together. The headband can be formed from flexible material such as spring steel or injection molded plastic to have a curvature that is slightly smaller than the anticipated size of a user's head. The headband 110 can press the earcups 140 against a user's head. The headband can include a sliding size adjuster 120 that permits the headband 110 to be lengthened or shortened to accommodate varying head sizes. The bracket 130 can connect to the headband 110 and sliding adjuster 120 via hinge 135. The hinge 135 can allow the bracket 130 and earcup 140 to rotate slightly to comfortably accommodate varying head geometry for a variety of users and also allow the headphones 100 to fold for storage. The bracket 130 can hold earcups 140 and also allow earcup 140 to rotate slightly about the mounting points to comfortably accommodate varying head geometries.

The earcups 140 can omit speakers and active electronics. Instead, the earcups 140 can have cavities (not shown) to receive and accept user-provided speakers such as earbuds. Earbuds are inexpensive and often included at no additional cost with many electronic devices. Earbuds can also be very expensive such as wireless earbuds provided by premium device manufacturers. The earcups 140 of the present invention can accept earbuds and effectively convert them to fancy over-the-ear style headphones. As will be explained in greater detail herein, the earcups 140 can include passive features like waveguides to improve the audio quality of earbuds.

Figure 2:
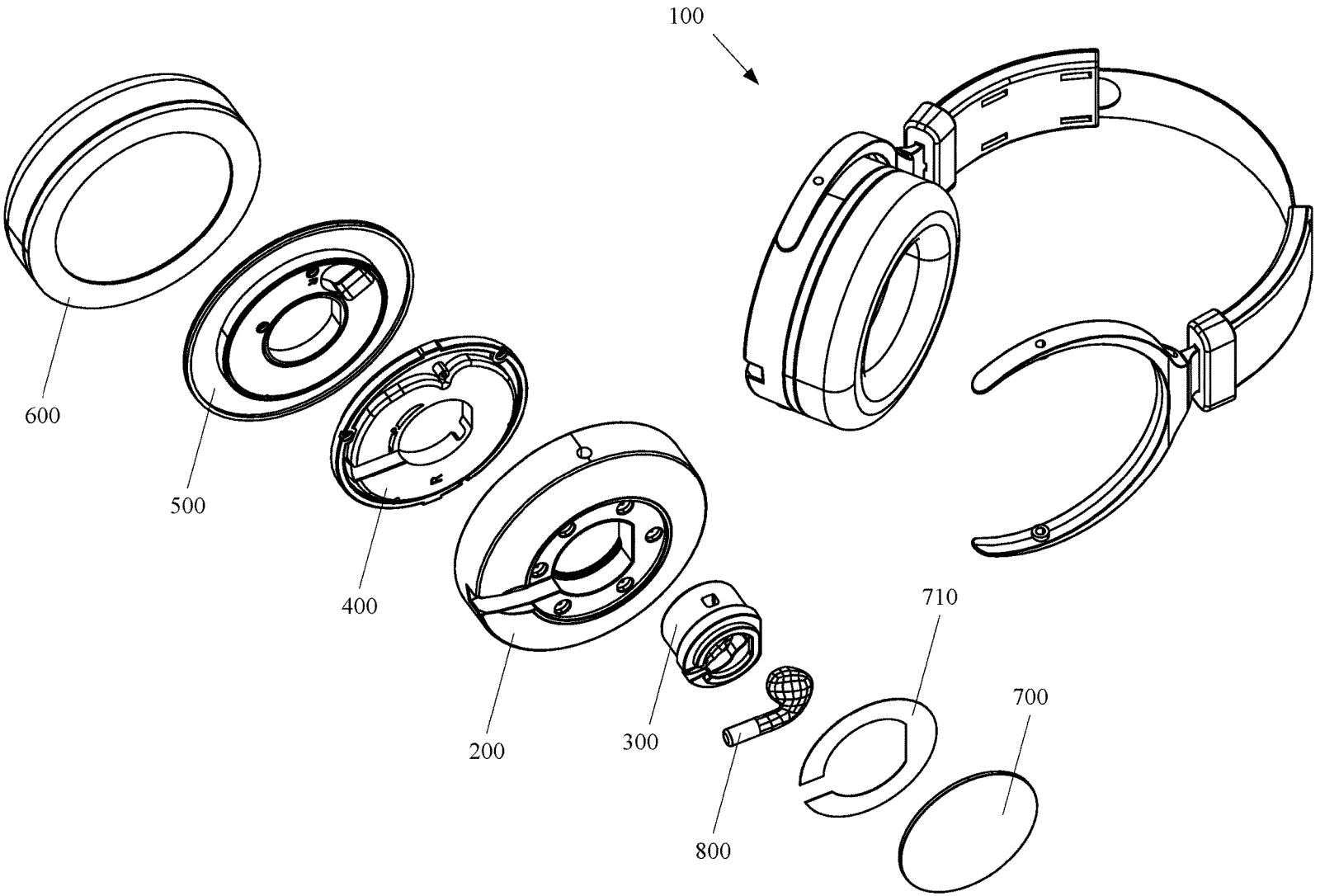
FIG. 2 is an exploded view of an earcup according to an exemplary embodiment of the invention.

FIG. 2 is an exploded view of an earcup for headphones according to an exemplary embodiment of the invention. As shown in FIG. 2, an earcup for headphones 100 includes a frame 200, a wave guide 300, another wave guide 400, a wave guide cover 500, a padded cover 600, a removable cover 700, retention padding 710, and an earbud 800.

The frame 200 can be the main body of the earcup. The frame 200 can sized to receive waveguide 300 from the outside and waveguide 400 from the inside. Waveguide cover 500 can cover waveguide 400. Padded cover 600 can stretch to fit around and generally cover waveguide cover 500.

Waveguide 300 can be formed from a resilient material such as rubber, neoprene, silicone, or latex. Waveguide 300 be sized in approximate proportions to receive and retain earbud 800. As will be discussed in greater detail herein, waveguide 300 can have ports to channel sound from the waveguide 300 through frame 200 and into waveguide 500. Removable cover 700 can attach to frame 200 to cover the waveguide 300 and earbud 800. Retention padding 710 can be disposed between frame 200 and removable cover 700 to prevent rattling and undesirable vibrations. Retention padding 710 can be formed from a resilient material such as felt, fabric, rubber, neoprene, or silicone. In preferred embodiments, the removable cover 700 is magnetically attached to the frame 200 and 700 retention padding 710 can cover and hold magnets in the frame 200.

The earbud 800 can be a wired or wireless earbud. In preferred embodiments, the earbud 800 is a common earbud that is an included accessory with popular cell phone models such as those manufactured by Samsung or Apple. The waveguide 300 can be formed in relative proportions to receive and hold such an earbud. Commercial embodiments of the invention can include multiple configurations of waveguide 300 to accommodate popular designs of earbuds 800.

Figure 3A:
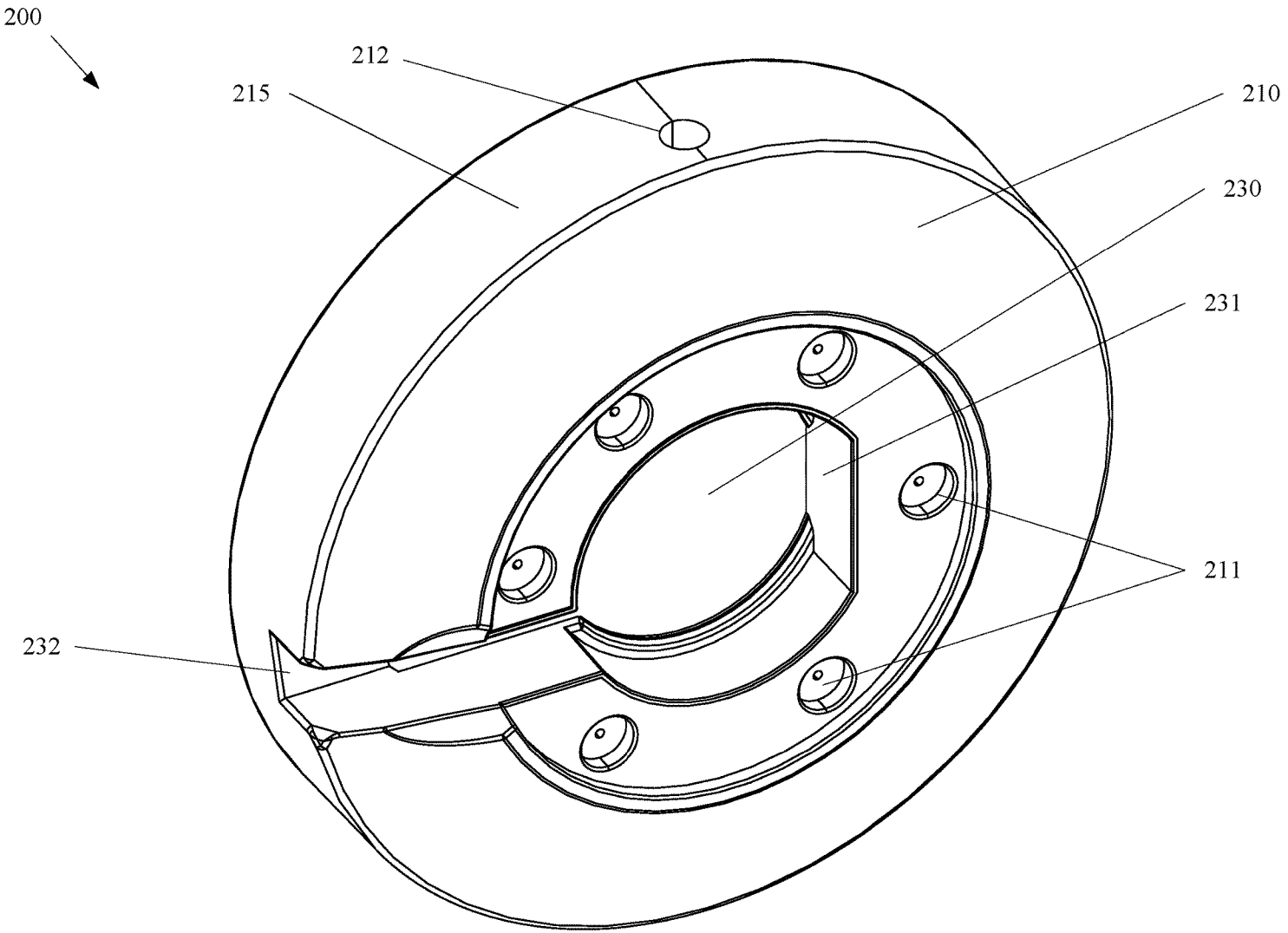
FIG. 3A is a view of an outside portion of a frame for an earcup according to an exemplary embodiment of the invention.
Figure 3B:
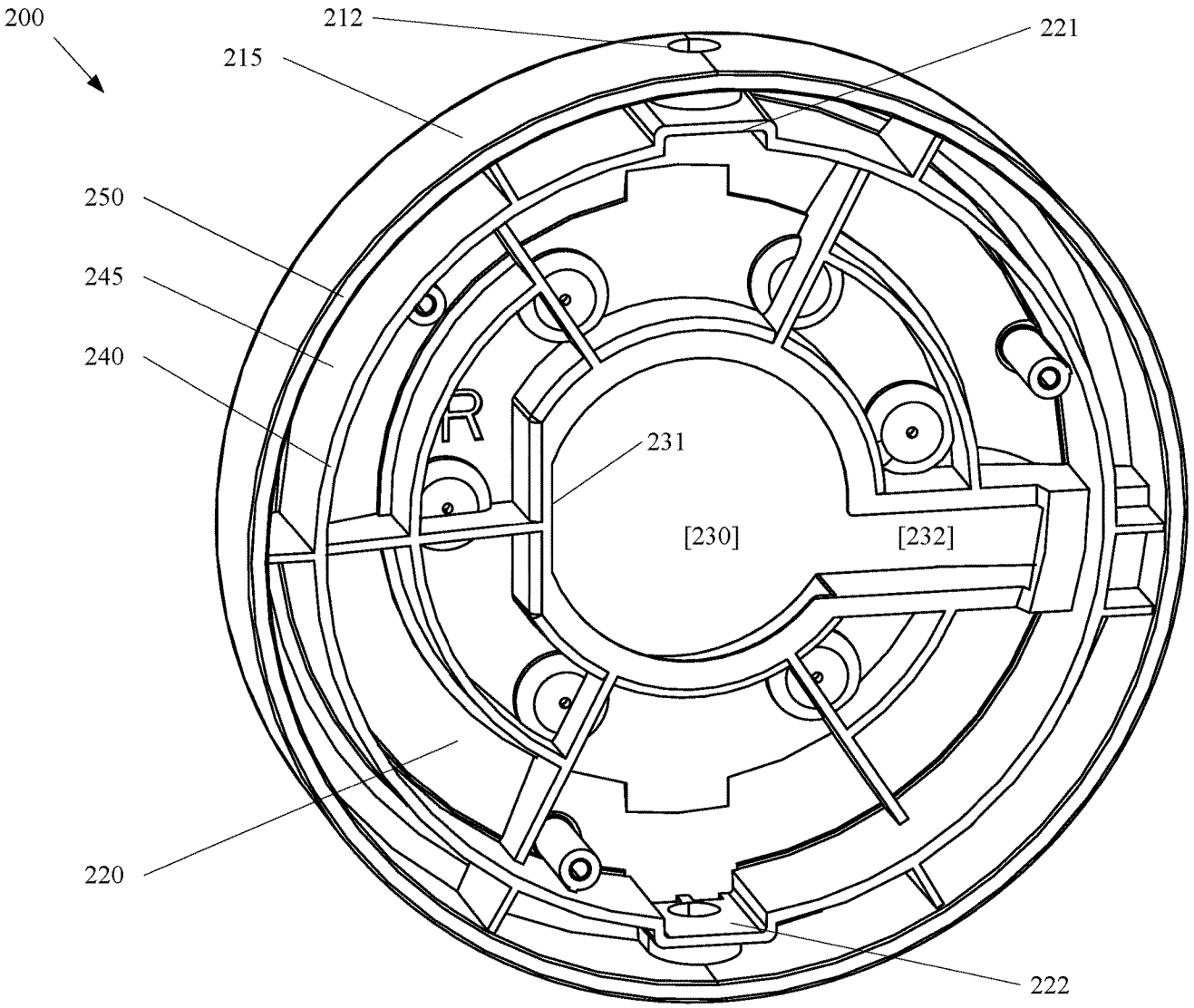
FIG. 3B is a view of an inside portion of a frame for an earcup according to an exemplary embodiment of the invention.

FIG. 3A is a view of an outside portion of a frame for an earcup according to an exemplary embodiment of the invention and FIG. 3B is a view of an inside portion of a frame for an earcup according to an exemplary embodiment of the invention. As shown in FIGS. 3A and 3B, a frame 200 for an earcup has an outside surface 210 (shown generally in FIG. 3A), an inside surface 220 (shown generally in FIG. 3B), and a perimeter surface 215. The outside surface 210 is intended to face away from a user's head when the headphones are properly worn and the inside 220 is intended to face towards a user's head when the headphones are properly worn.

The frame 200 has a central hole 230 for receiving a waveguide (e.g. FIG. 4A-4D). The central hole 230 of the frame 200 has a keyed portion 231. A notch 232 extends radially from the central hole 230 through the frame 200 to the perimeter surface 215. The keyed portion 230 can be sized in relative shape and located in relative position to correspond to a mating keyed portion of a wave guide (e.g. FIG. 4A-4D). The notch 232 can be sized in relative proportions to accommodate a stem of an earbud and to allow a cable of an earbud to exit the frame 200.

The perimeter surface 215 of the frame 200 can include a mounting hole 212 for connecting the frame 200 to a mounting bracket of headphones (e.g. bracket 130 of FIG. 1). The inside 220 of the frame 200 can have an inner perimeter wall 240, and outer perimeter wall 250, and a space 245 between the inner perimeter wall 240 and outer perimeter wall 250. The perimeter walls 240 and 250 can be generally circular in shape (as illustrated) and disposed at an edge of the frame 200. The perimeter surface 215 is disposed on the outer surface of the outer perimeter wall 250. The perimeter walls 240 and 250 and the space 245 can cooperate to provide sound isolation.

The inner perimeter wall 240 can have keyed portions 221 and 222. The keyed portions 221 and 222 can correspond in relative size and location to mating keyed portions of a waveguide (not shown) such as elements 421 and 422 of FIG. 5A, respectively. The keyed portions 221 and 222 can ensure that the waveguide is properly oriented with respect to the frame 200.

The frame 200 can be formed from a lightweight rigid material such as injection molded plastic, zinc, or aluminum.

Figure 4A:
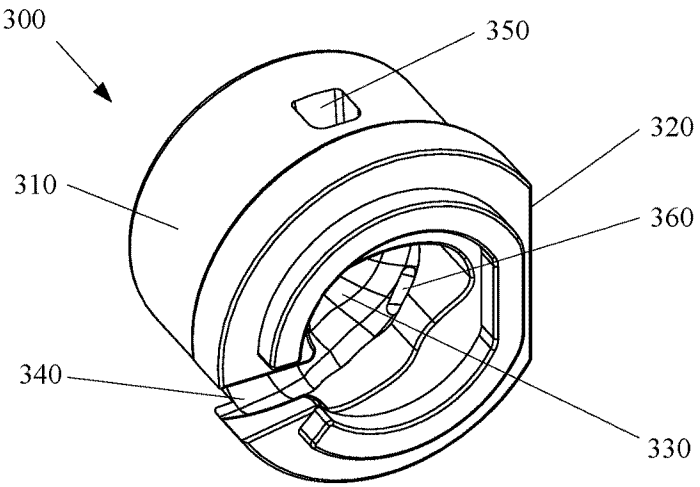
FIG. 4A and FIG. 4B are views of an outside portion of a waveguide for an earcup according to an exemplary embodiment of the invention.
Figure 4B:
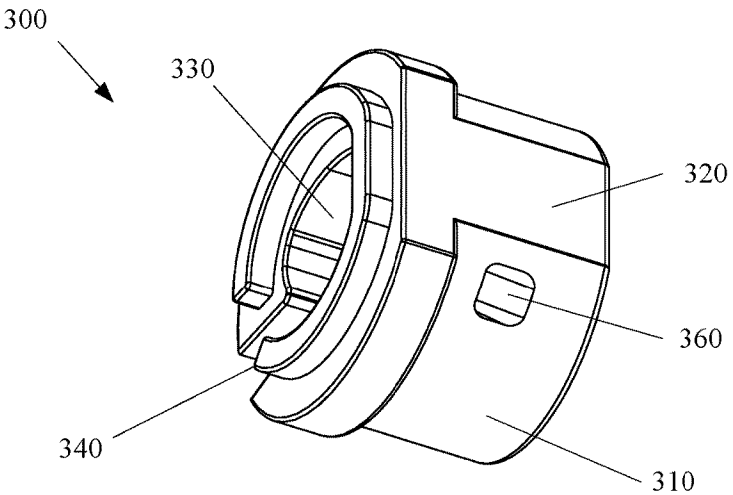
Figure 4C:
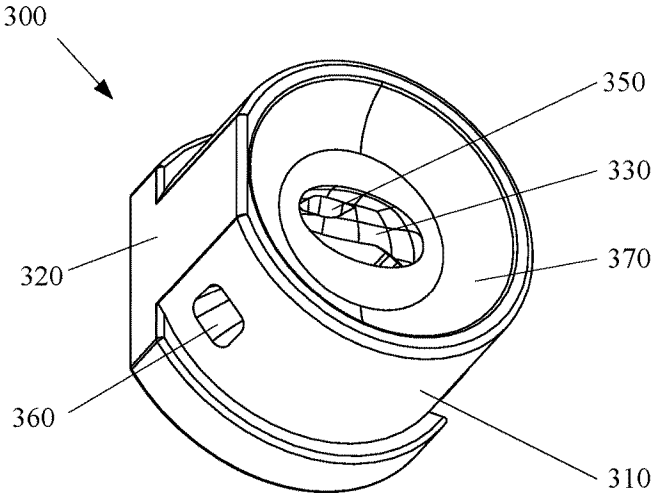
FIG. 4C and FIG. 4D are views of an inside portion of a waveguide for an earcup according to an exemplary embodiment of the invention.
Figure 4D:
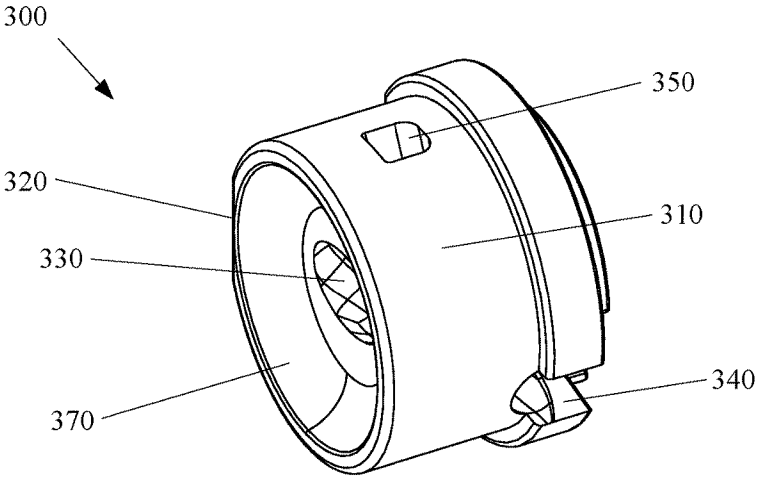

FIG. 4A and FIG. 4B are views of an outside portion of a waveguide for an earcup according to an exemplary embodiment of the invention and FIG. 4C and FIG. 4D are views of an inside portion of a waveguide for an earcup according to an exemplary embodiment of the invention. As shown in FIG. 4A-4D, a waveguide 300 for an earcup has a perimeter surface 310, a keyed portion 320, a central hole 330, a slot 340, ports 350 and 360, and a concave portion 370.

The waveguide 300 and keyed portion 320 can be sized in relative proportions and disposed in relative locations to be snugly received within the central hole of the frame. The central hole 330 can be shaped to receive and retain an earbud. The central hole 330 can extend from the outside of the waveguide to the inside of the waveguide. A speaker portion of an earbud can project through the central hole 330 to the inside of the waveguide. Slot 340 can extend from the central hole 330 to the perimeter surface 310 to allow a stem of the earbud to protrude from the central hole into the slot of the frame (FIG. 3A, element 232).

Ports 350 and 360 can extend substantially radially from inside the central hole 330 through and to the perimeter surface 310. Although many earbuds have sound ports that project directly into a user's ear, some earbuds have ports oriented on their sides. Ports 350 and 360 can capture sound emitted from side-oriented sound ports of an earbud and redirect the sound into a second wave guide (e.g. FIGS. 5A and 5B).

The inside portion of the waveguide 300 can have a concave portion 370. The concave portion can function like a speaker cone to direct and passively amplify the sound produced by an earbud. The waveguide 300 is preferably formed from a resilient material that can bend and flex slightly to accommodate insertion into the central hole of the frame and to accommodate the insertion of an earbud therein. The waveguide 300 can be formed from rubber or a rubber-like material such as silicone, latex, neoprene, or foam. In commercial embodiments of the invention, it is contemplated that multiple waveguides 300 having varying configurations will be included in commercial packaging so that users can select a waveguide that best fits their earbuds. The waveguide can be easily pulled from the central hole of the frame and a different waveguide can be inserted in its place.

Figure 5A:
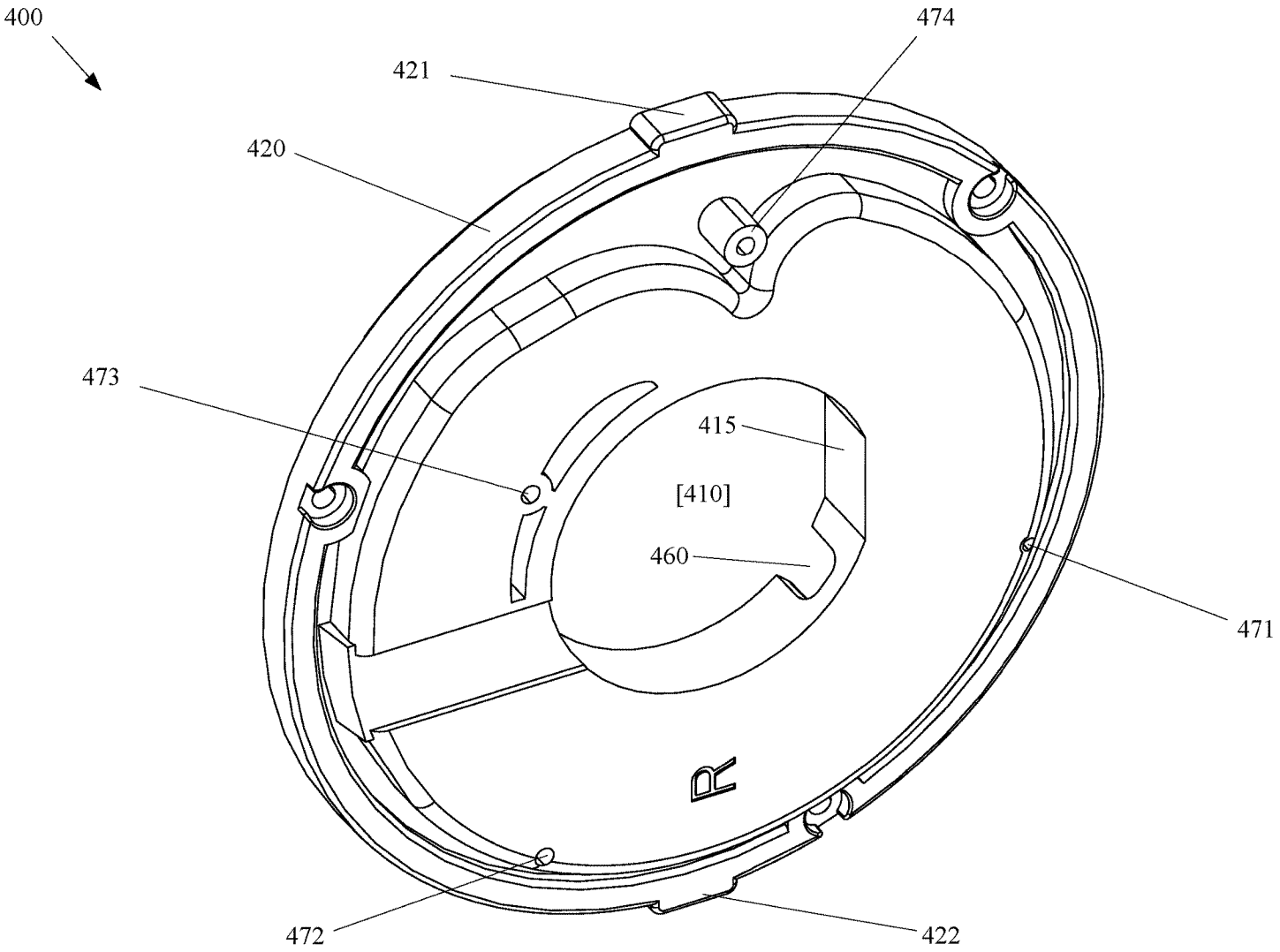
FIG. 5A is a view of an outside portion of a waveguide for an earcup according to an exemplary embodiment of the invention.
Figure 5B:
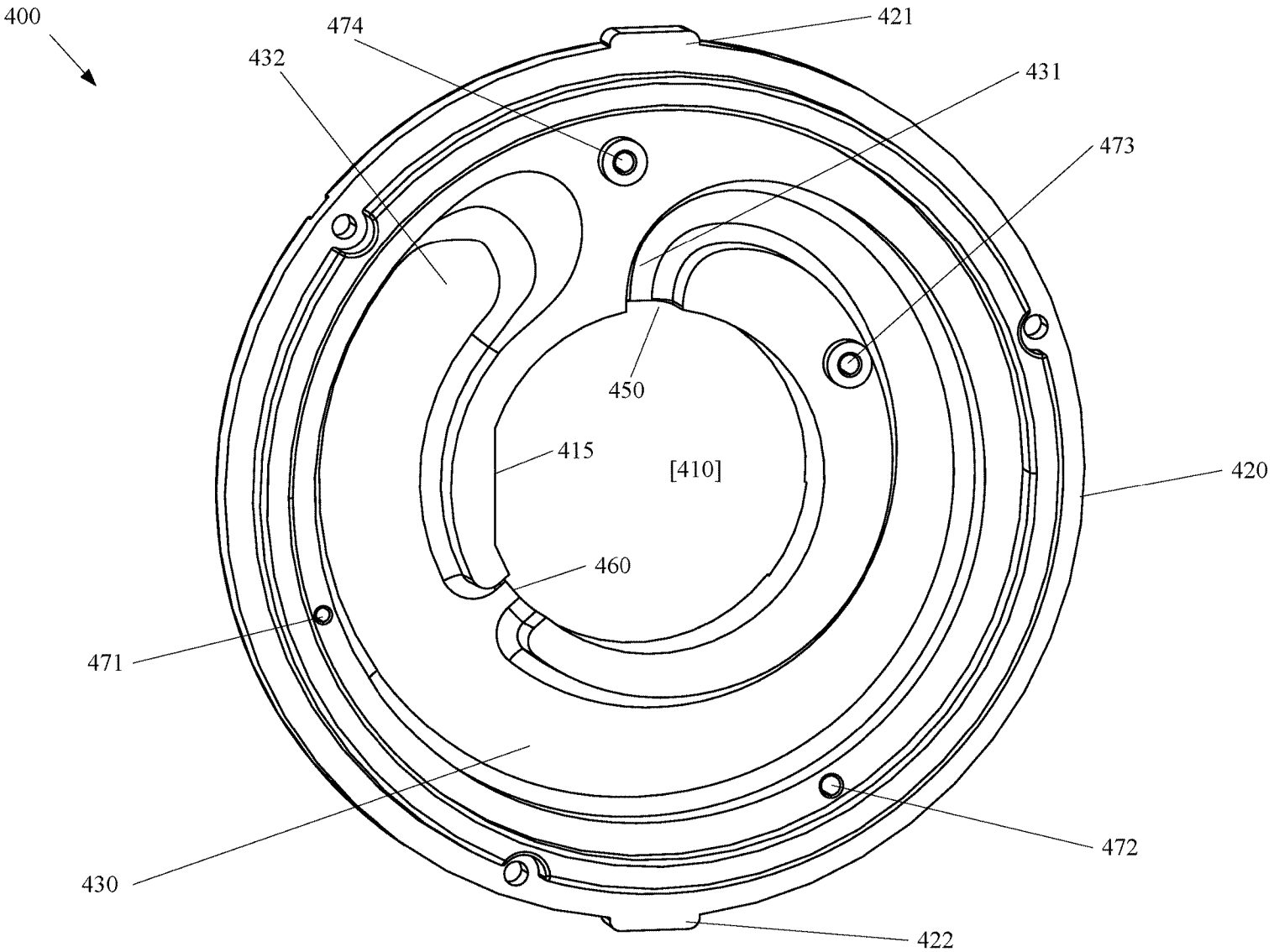
FIG. 5B is a view of an inside portion of a waveguide for an earcup according to an exemplary embodiment of the invention.

FIG. 5A is a view of an outside portion of a waveguide for an earcup according to an exemplary embodiment of the invention and FIG. 5B is a view of an inside portion of a waveguide for an earcup according to an exemplary embodiment of the invention. As shown in FIG. 5A and FIG. 5B, a waveguide 400 can include a central hole 410, a keyed portion 415 of the central hole, a perimeter surface 420, a ring-shaped channel 430, and ports 450 and 460. The ring-shaped channel 430 can have a first end 431 and a second end 432. The perimeter surface 420 can have keyed portions 421 and 422. The inside surface (shown in FIG. 5B) of the waveguide 400 can have asymmetrically disposed screw holes 471, 472, 473, and 473.

The waveguide 400 can be sized in relative proportions such that the perimeter surface 420 can nest inside the inner perimeter wall of the frame. The central hole 410 and the keyed portion 415 can be sized in relative proportions to receive waveguide 300 of FIGS. 4A-4D. Ports 450 and 460 can correspond in relative size and location to ports 350 and 360 of waveguide 300 of FIG. 4A-4D. The first end 431 of the ring-shaped channel 430 can be narrower than the second end 432 of the ring-shaped channel 430. Port 450 can be positioned adjacent to bass port of popular brands of earbuds such that sound is channeled through the port 450 into the first end 431 of ring-shaped channel 430 where it is guided and directed around the waveguide 400 to the second end 432. Port 460 can be positioned adjacent to a mid-bass port of popular brands of earbuds such that sound is channeled through the port 460 into the ring-shaped channel 430 where it is guided and directed around the waveguide 400 to the second end 432. The redirection of bass and mid-bass through the ring-shaped channel 430 channel can cause the sound to seem deeper and fuller.

Keyed portions 421 and 422 can be disposed on the perimeter edge 420 and can correspond in relative size and location to keyed portions 221 and 222 of the frame 200. The keyed portions can ensure that the waveguide 400 is properly oriented within the frame so that the ports (e.g. 450 and 460) align with the ports of other components.

Figure 6A:
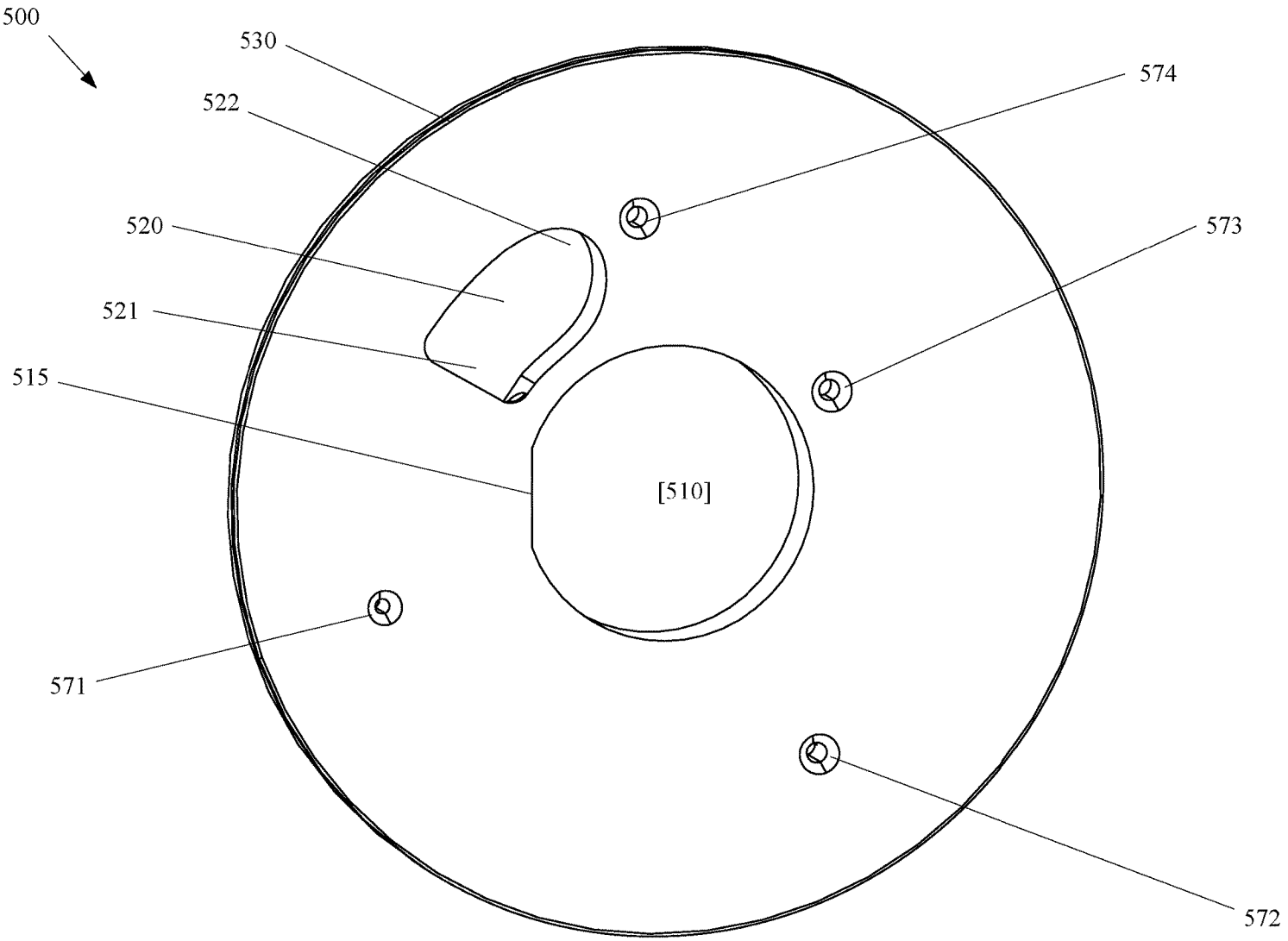
FIG. 6A is a view of an inside portion of a waveguide cover for an earcup according to an exemplary embodiment of the invention.
Figure 6B:
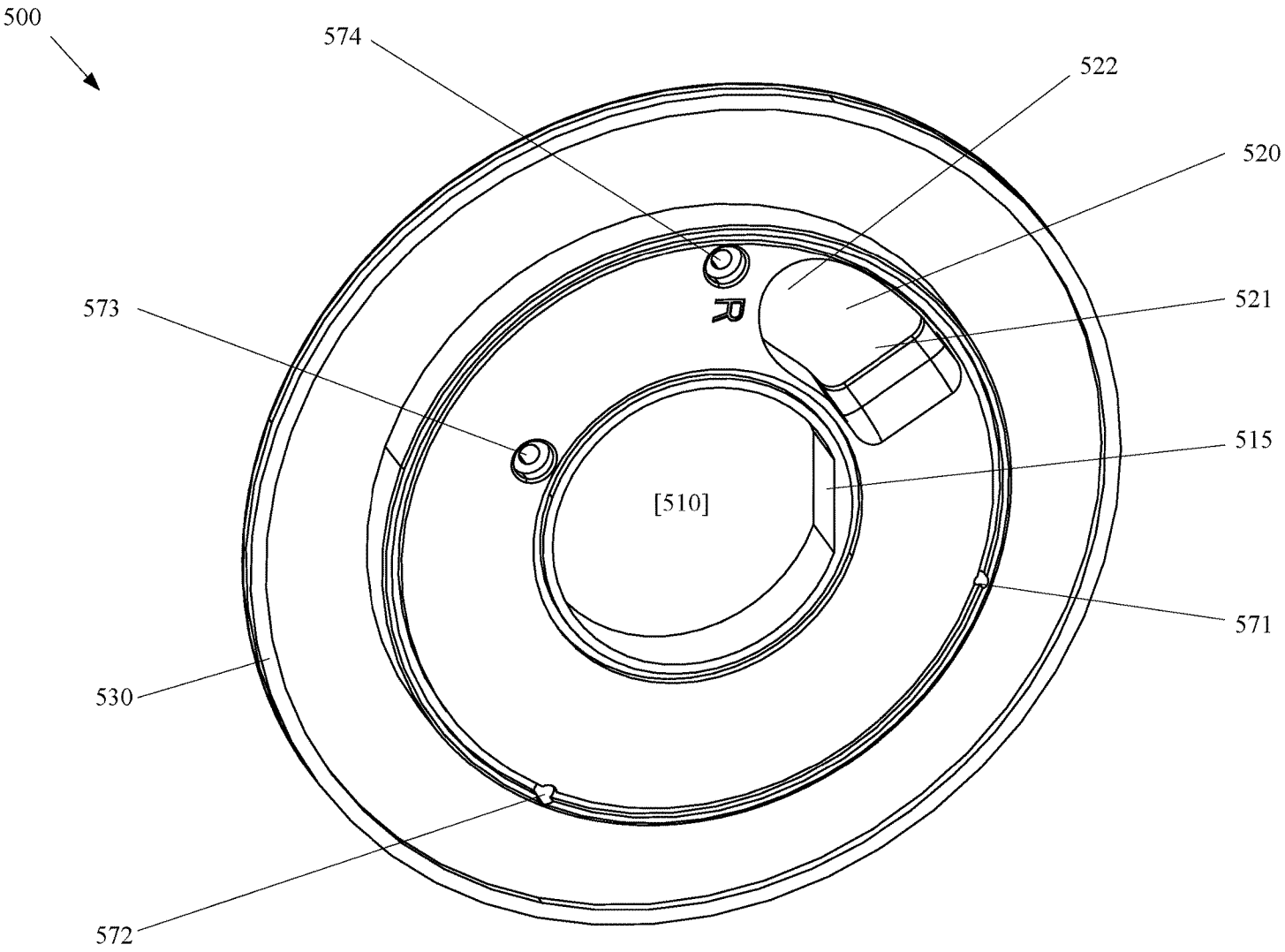
FIG. 6B is a view of an outside portion of a waveguide cover for an earcup according to an exemplary embodiment of the invention.

FIG. 6A is a view of an inside portion of a waveguide cover for an earcup according to an exemplary embodiment of the invention and FIG. 6B is a view of an outside portion of a waveguide cover for an earcup according to an exemplary embodiment of the invention. As shown in FIG. 6A and FIG. 6B, a waveguide cover 500 includes a central hole 510 having keyed portion 515, a port 520 and a perimeter edge 530. The port 520 has a first side 521 that is flat and a second side 522 that is curved. The waveguide cover 500 includes asymmetrically disposed screw holes 571, 572, 573, and 574.

The central hole 510 and keyed portion 515 can correspond in relative size and location to the central hole and keyed portions of waveguide 400 and frame 200. The central hole 510 and keyed portion 515 can be sized to receive waveguide 300. Waveguide cover 500 can cover waveguide 400 and seal the ring-shaped channel 430 such that sound entering the ring-shaped channel is directed to port 520.

Port 520 in cover 500 can be an exit port for sound from the ring-shaped channel of the waveguide 400. The first side 521 of port 520 is flat and the second side 522 of the port 520 is generally rounded. The port 520 is generally shaped to open over the second end of the ring-shaped waveguide and direct sound emanating from the ring-shaped waveguide.

The asymmetrically disposed screw holes 571, 572, 573, and 574 can correspond to screw holes in the waveguide 400. The screw holes 571, 572, 573, and 574 are preferably asymmetrically disposed to prevent accidental misalignment of the cover 500 with the underlying waveguide 400. The holes 571, 572, 573, and 574 are asymmetrically disposed with respect to ensure that the cover 500 can only be attached to the waveguide 400 in a single orientation. The screw holes 571, 572, 573, and 574 are asymmetric because there is no line that can be drawn through the cover 500 such that the holes are symmetrically disposed on either side of the line.

Figure 7A:
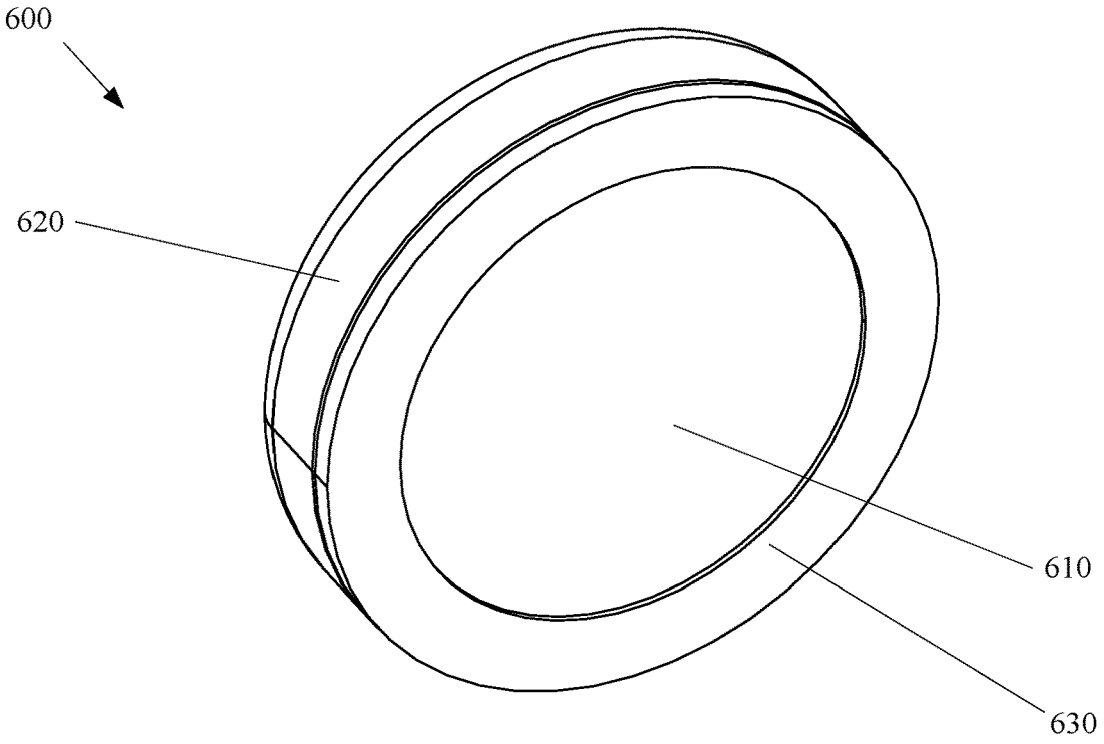
FIG. 7A is a view of an outside portion of a padded cover for an earcup according to an exemplary embodiment of the invention.

The perimeter edge 530 can be an attachment point for the padded cover (FIG. 7A). When the cover 500 is attached to waveguide 400, a small gap (not labeled) is created between the perimeter edge 530 of the cover 500 and perimeter edge 420 of the waveguide 400. The gap can receive an elastic band of a padded cover to secure the padded cover to the waveguide cover 500.

Figure 7B:
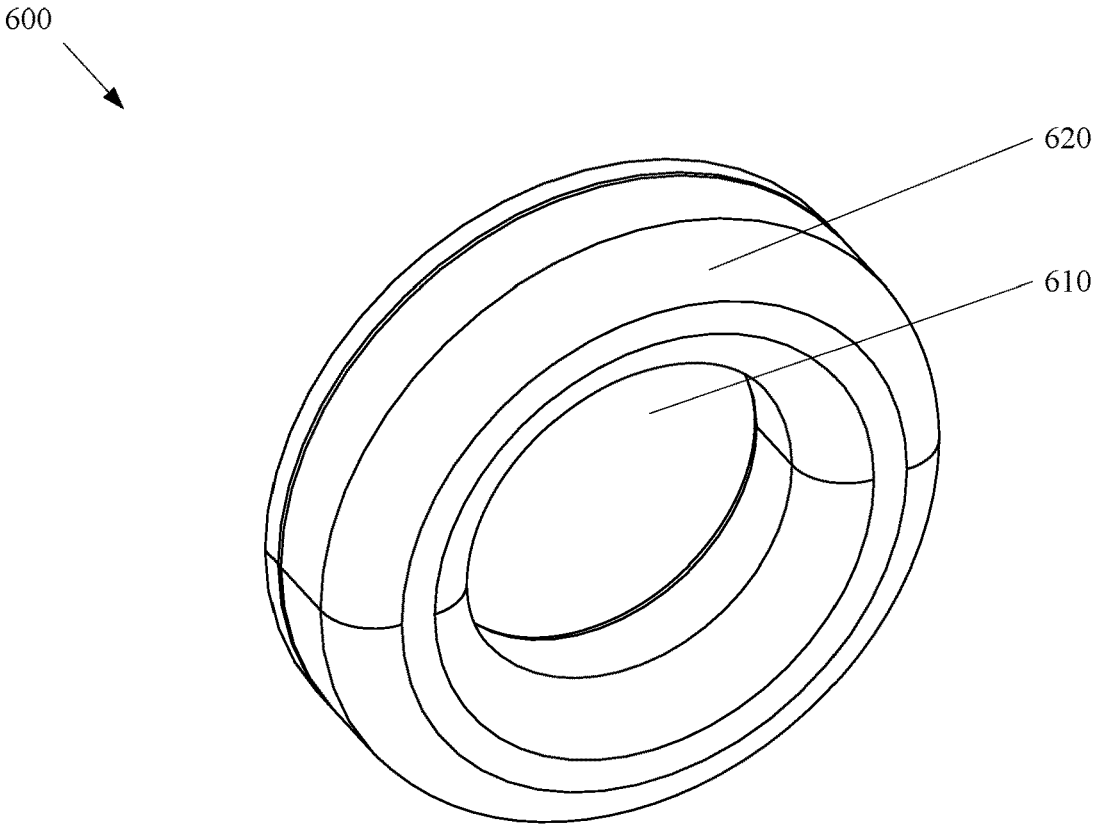
FIG. 7B is a view of an inside portion of a padded cover for an earcup according to an exemplary embodiment of the invention.

FIG. 7A is a view of an outside portion of a padded cover for an earcup according to an exemplary embodiment of the invention and FIG. 7B is a view of an inside portion of a padded cover for an earcup according to an exemplary embodiment of the invention. As shown in FIG. 7A and FIG. 7B, a padded cover 600 for an earcup includes a fabric screen 610, a cushioned portion 620, and retention band 630. The fabric screen 610 can provide an aesthetic cover for waveguide cover 500 and obscure the holes and ports therein. The cushioned portion can surround a user's ear and ensure that the earcups are comfortable to wear. The retention band 630 can be formed with stretchable material such as elastic and sized in relative proportions such that the retention band 630 can stretch to surround and be retained by a perimeter edge 530 of the waveguide cover 500.

Figure 8:
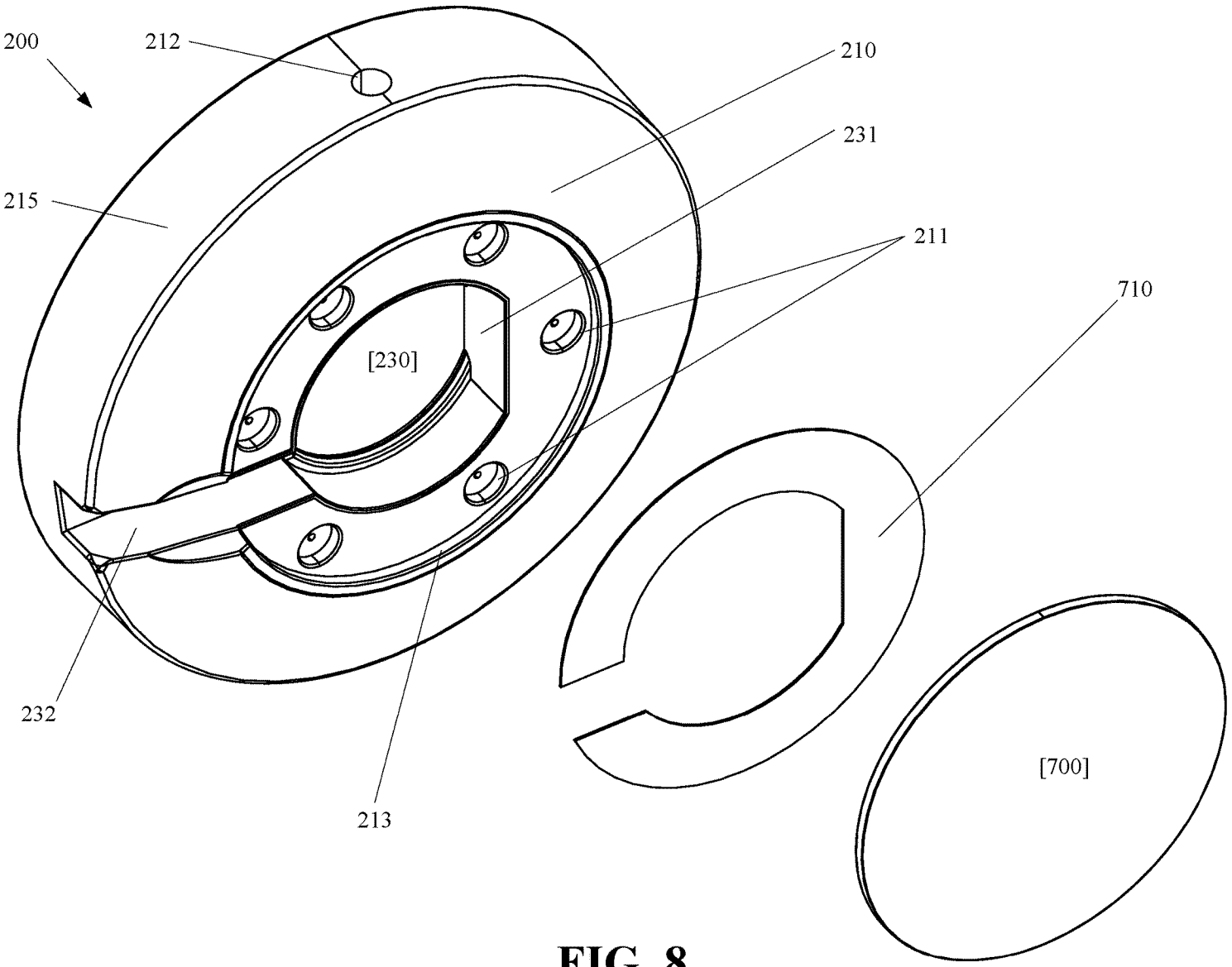
FIG. 8 is an exploded view of the outside portion of a frame and removable cover for an earcup according to an exemplary embodiment of the invention.

FIG. 8 is an exploded view of the outside portion of a frame and removable cover for an earcup according to an exemplary embodiment of the invention. As shown in FIG. 8, a frame 200 includes a central hole 230, a keyed portion 231, an outside portion 210, a perimeter edge 215, channel 232, recessed portion 213. Holes 211 can be sized to receive magnets (not shown). Magnets can be held in the holes 211 with glue.

Removable cover 700 can attach to frame 200 to cover a waveguide (not shown) and earbud (not shown). Retention padding 710 can be disposed between frame 200 and removable cover 700 to prevent rattling and undesirable vibrations. Retention padding 710 can be formed from a resilient material such as felt, fabric, rubber, neoprene, or silicone. In preferred embodiments, the removable cover 700 is magnetically attached to the frame 200 and 700 retention padding 710 can cover and hold magnets in the frame 200.

The removable cover 700 is preferably formed form a ferrous material so that the force of magnetic attraction can hold the removable cover 700 in the recessed portion 213 of the frame 200. Although magnets have been shown and described as an attachment mechanism to hold a removable cover on the frame, other methods of attachment will be apparent to those of skill in the art and are considered within the scope of this invention.

In commercial embodiments, it is contemplated that the removable cover 700 is inexpensive and customizable. Removable covers may be provided as give-aways at sporting events such as football games or basketball games and customized to include team logos. In another example, removable covers may be provided as give-aways at corporate promotions such as by a bank upon opening an account, or at a store upon applying for a loyalty club. It is contemplated that a market will emerge for others to buy, sell, and trade inexpensive covers to customize and personalize their earcups according to embodiments of the invention.

Figure 9A:
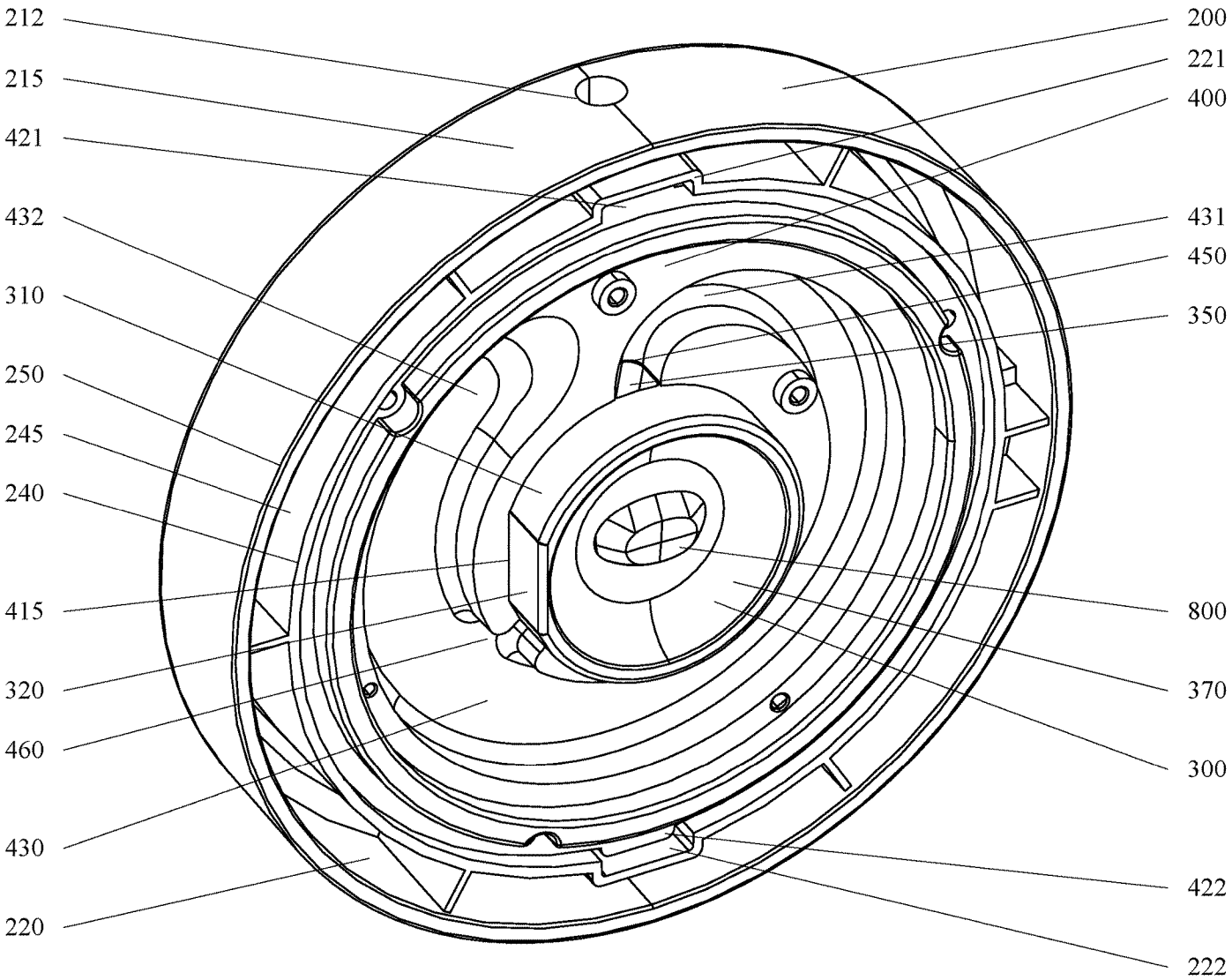
FIGS. 9A and 9B are assembled views of the inside portion of a frame, two waveguides, and an earbud for an earcup according to an exemplary embodiment of the invention.
Figure 9B:
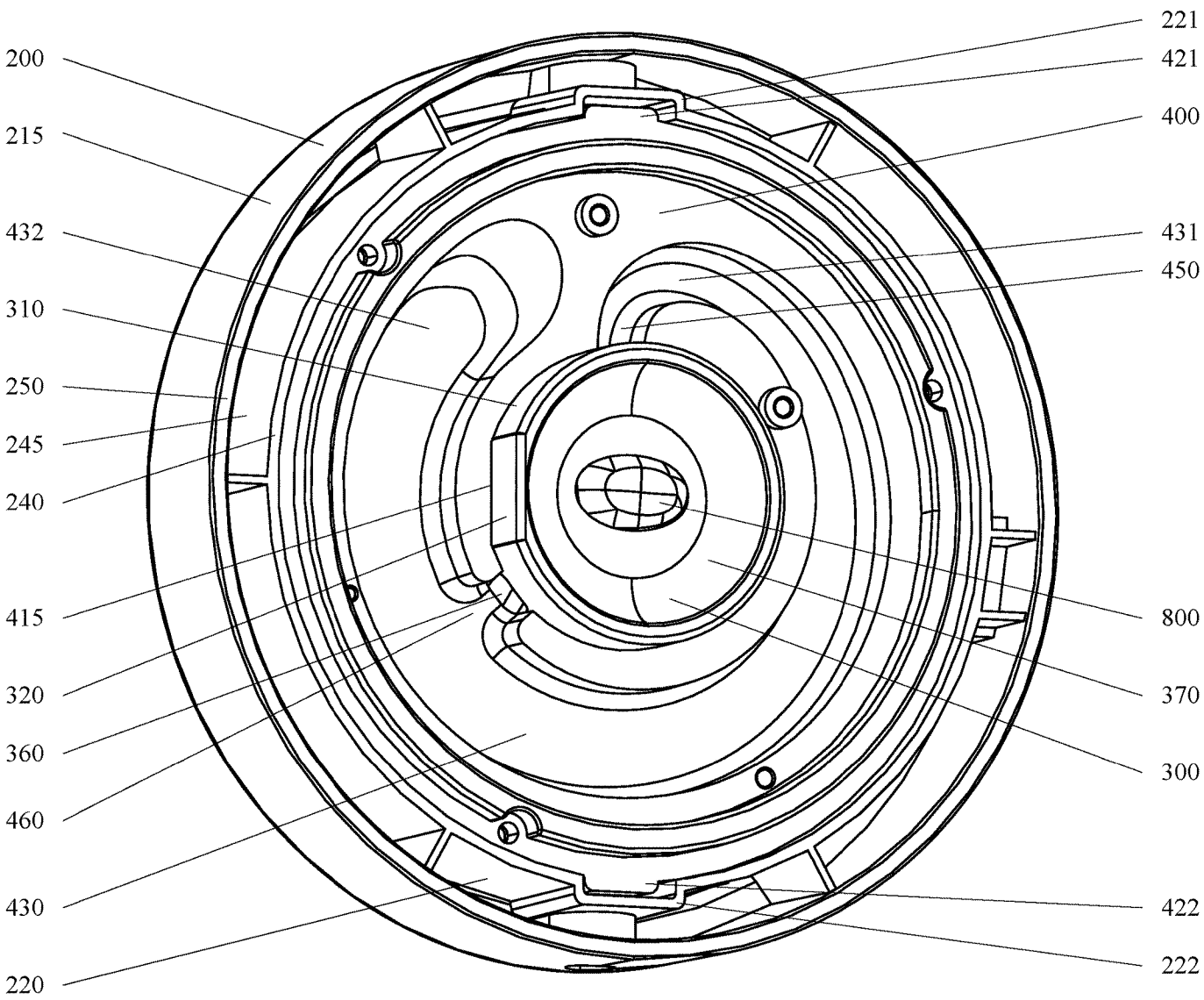

FIGS. 9A and 9B are assembled views of the inside portion of a frame, two waveguides, and an earbud for an earcup according to an exemplary embodiment of the invention. As shown in FIGS. 9A and 9B, a waveguide 400 is nested in a frame 200 and waveguide 300 is inserted through the central hole of the frame (not shown) into the central hole 415 of the waveguide 400. The ports 350 and 360 of the waveguide 300 align with ports 450 and 460 of waveguide 400, respectively. An earbud 800 is inserted into the waveguide 300 and protrudes into the concave portion 370 thereof.

Sound emanating from a first port (not shown) on the earbud 800 can enter port 350 of the wave guide 300 and be guided into port 450 of the waveguide 400. Port 450 can connect to a first end 431 of ring-shaped channel 430. Ring-shaped channel 430 can direct sound through and to the second end 432 where it is configured to be disposed below a port of a waveguide cover (e.g. port 420).

Sound emanating from a second port (not shown) on the earbud 800 can enter port 360 of the waveguide 300 and be guided into port 460 of the waveguide 400. Port 460 can connect to the ring-shaped channel 430 and, in cooperation, direct sound through and to the second end 432 where it is configured to be disposed below a port of a waveguide cover (e.g. port 420).

Keyed portions 221 and 222 of the frame 200 can mate with keyed portions 421 and 422 of the waveguide 400 to ensure proper orientation of the waveguide 400 within the frame 200. Keyed portion 320 of the wave guide 300 can mate with corresponding keyed portions of the frame (not shown) and waveguide cover 415. The perimeter edge 310 of waveguide 300 can nest snugly inside the waveguide 400 and frame 200.

Inner perimeter wall 240 and outer perimeter wall 250 of the frame 200 can provide rigidity and sound isolation to the assembly. A space 245 is optionally formed between the inner and outer walls. The perimeter surface 215 can include a mounting point 212 to attach the assembly to a bracket of headphones.

Figure 9C:
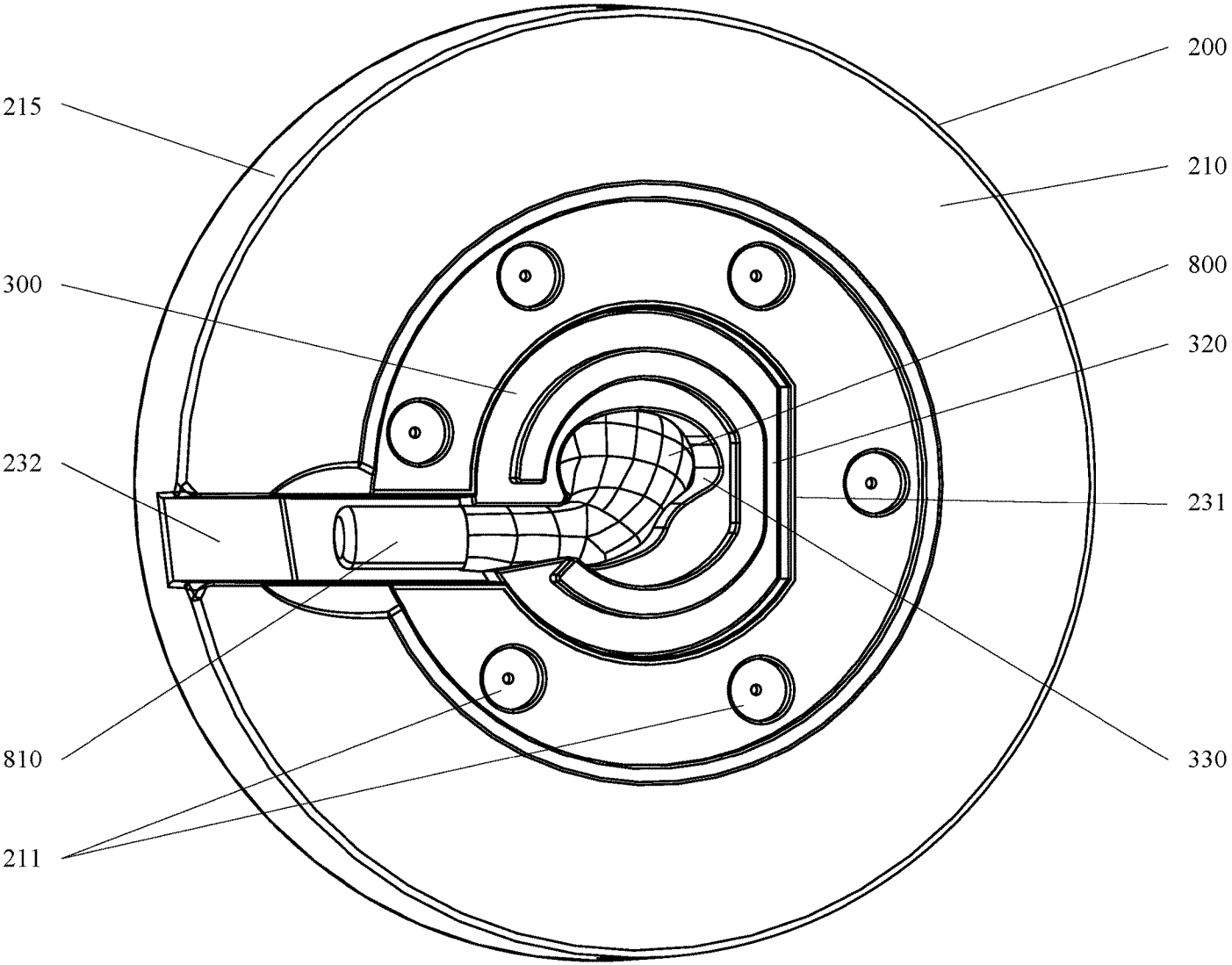
FIG. 9C is an assembled view of the outside portion of a frame, waveguide, and earbud for an earcup according to an exemplary embodiment of the invention.

FIG. 9C is an assembled view of the outside portion of a frame, waveguide, and earbud for an earcup according to an exemplary embodiment of the invention. As shown in FIG. 9C an earcup can include a frame 200, a waveguide 300, and an earbud 800. The frame can include an outside surface 210, a perimeter surface 215, and magnet holes 211. A central hole of the frame can include a keyed portion 231 and a channel 232. The waveguide 300 can include a central hole 330 a keyed portion 320. An earbud 800 can include a step 810.

The waveguide 300 can be inserted into the central hole of the frame 200 such that the respective keyed portions align and cooperation to orient the waveguide 300 with respect to the frame 200. The earbud 800 can be inserted into the central hole 300 waveguide 300 such that the stem 810 of the earbud protrudes out of the central hole 330 into the channel 232 of the frame 200. Holes 211 can receive magnets (not shown) which can be retained therein with glue, friction pressure or a non-ferrous cover (e.g. cover 710).

It will be apparent to those skilled in the art that various modifications and variations can be made in the headphone earcup without departing from the spirit or scope of the invention. Thus, it is intended that embodiments of the invention cover the modifications and variations of this invention provided they come within the scope of the appended claims and their equivalents.

What is claimed is:

1. An earcup for headphones, the earcup comprising:

a frame having an inside surface to be positioned adjacent a user's head, an outside surface opposite the inside surface, and a first perimeter surface;

a central hole in the frame extending from the inside surface to the outside surface;

a removable cover on the outside surface of the frame, the removable cover covering the central hole in the frame;

a first wave guide for holding an earbud, the first wave guide having a second perimeter surface and sized in relative proportions to nest in the central hole of the frame;

a second wave guide positioned on the inside surface of the frame;

a ring-shaped channel partially surrounding a central hole of the second wave guide, the ring-shaped channel having a first end and a second end;

a cover for the second wave guide; and a padded cover over the cover of the second wave guide.

2. The earcup of claim 1 wherein the removable cover is magnetically attached to the outside surface of the frame.

3. The earcup of claim 1 further comprising:

an inner perimeter wall of the frame;

an outer perimeter wall of the frame defining the first perimeter surface; and a gap between the inner perimeter wall and the outer perimeter wall.

4. The earcup of claim 1 further comprising:

a keyed portion of the central hole in the frame; and a slot extending radially from the central hole in the frame through the first perimeter surface.

5. The earcup of claim 1 further comprising:

a keyed portion of the first wave guide sized in relative proportions and located in relative position to mate with a mating keyed portion of the central hole in the frame.

6. The earcup of claim 1 further comprising:

a central hole in the first wave guide sized in relative proportions to receive the earbud.

7. The earcup of claim 1 further comprising:

a central hole in the first wave guide; and a slot of the first wave guide for receiving a stem of the earbud, the slot extending radially from the central hole of the first wave guide to the second perimeter surface of the first wave guide.

8. The earcup of claim 1 further comprising:

a central hole in the first wave guide; and a first port of the first wave guide, the first port extending radially from the central hole of the first wave guide to the second perimeter surface of the first wave guide.

9. The earcup of claim 8 further comprising:

a second port of the first wave guide, the second port extending radially from the central hole of the first wave guide to the second perimeter surface of the first wave guide.

10. The earcup of claim 1 further comprising:

a keyed portion of the second wave guide, the keyed portion of the second wave guide sized in relative proportions and positioned in relative location to correspond to a mating keyed portion of the frame;

wherein the second wave guide is sized in relative proportions to nest inside the frame.

11. The earcup of claim 1 further comprising:

wherein the second end of the ring-shaped channel is wider than the first end of the ring-shaped channel.

12. The earcup of claim 1 further comprising:

a first port of the second wave guide, the first port opening from the central hole of the second wave guide to the ring-shaped channel near the first end of the ring-shaped channel; and a second port of the second wave guide, the second port opening from the central hole of the second wave guide to the ring-shaped channel.

13. The earcup of claim 1 further comprising:

a plurality of asymmetrically disposed screw holes in the cover for the second wave guide, the asymmetrically disposed screw holes positioned in relative location to correspond to a corresponding plurality of asymmetrically disposed screw holes in the second wave guide.

14. The earcup of claim 1 further comprising:

a central hole of the cover for the second wave guide;

a port in the cover for the second wave guide, the port radially offset from the central hole of the cover for the second wave guide, and positioned such that when the cover for the second wave guide is mated with the second wave guide, that the port in the cover is disposed over the second end of the ring-shaped channel of the second wave guide.

15. An earcup for headphones, the earcup comprising:

a frame having an inside surface to be positioned adjacent a user's head, an outside surface opposite the inside surface, and a first perimeter surface;

a central hole in the frame extending from the inside surface to the outside surface;

a slot extending radially from the central hole through the first perimeter surface;

a first wave guide for holding an earbud and having a second perimeter surface, the first wave guide sized in relative proportions to nest in the central hole of the frame;

a central hole in the first wave guide, the central hole of the first wave guide sized in relative proportions to receive the earbud;

a slot of the first wave guide for receiving a stem of the earbud, the slot extending radially from the central hole of the first wave guide to the second perimeter surface of the first wave guide;

a second wave guide;

a central hole of the second wave guide;

a ring-shaped channel partially surrounding the central hole of the second wave guide, the ring-shaped channel having a first end and a second end; and a cover for the second wave guide.

16. The earcup of claim 15 further comprising:

a first port of the first wave guide, the first port extending radially from the central hole of the first wave guide to the second perimeter surface of the first wave guide; and a second port of the first wave guide, the second port extending radially from the central hole of the first wave guide to the second perimeter surface of the first wave guide.

17. The earcup of claim 15 further comprising:

a first port of the second wave guide, the first port opening from the central hole of the second wave guide to the ring-shaped channel near the first end of the ring-shaped channel; and a second port of the second wave guide, the second port opening from the central hole of the second wave guide to the ring-shaped channel; and wherein the second end of the ring-shaped channel is wider than the first end.

18. The earcup of claim 15 further comprising:

a central hole of the cover for the second wave guide; and a port in the cover for the second wave guide, the port radially offset from the central hole of the cover, and positioned such that when the cover for the second wave guide is mated with the second wave guide, that the port in the cover for the second wave guide is disposed over the second end of the ring-shaped channel of the second wave guide.

19. The earcup of claim 15 further comprising:

a padded cover having an elastic ring, the elastic ring configured to stretch to cover a perimeter of the cover for the second wave guide.

20. An earcup for headphones, the earcup comprising:

a frame having an inside surface to be positioned adjacent a user's head, an outside surface opposite the inside surface, and a first perimeter surface;

a central hole in the frame extending from the inside surface to the outside surface;

a slot extending radially from the central hole through the first perimeter surface;

a first wave guide for holding an earbud and having a second perimeter surface, the first wave guide sized in relative proportions to nest in the central hole of the frame;

a central hole in the first wave guide, the central hole of the first wave guide sized in relative proportions to receive the earbud;

a first port of the first wave guide, the first port extending radially from the central hole of the first wave guide to the second perimeter surface of the first wave guide;

a slot of the first wave guide for receiving a stem of the earbud, the slot extending radially from the central hole of the first wave guide to the second perimeter surface of the first wave guide;

a second wave guide;

a central hole of the second wave guide;

a ring-shaped channel partially surrounding the central hole of the second wave guide, the ring-shaped channel having a first end and a second end;

a first port of the second wave guide, the first port opening from the central hole of the second wave guide to the ring-shaped channel near the first end of the ring-shaped channel;

a cover for the second wave guide;

a central hole of the cover for the second wave guide; and a port in the cover for the second wave guide, the port radially offset from the central hole of the cover, and positioned such that when the cover for the second wave guide is mated with the second wave guide, that the port in the cover for the second wave guide is disposed over the second end of the ring-shaped channel of the second wave guide.

* * * * *